United States Patent [19]

Naylor et al.

[11] Patent Number: 4,759,726

[45] Date of Patent: Jul. 26, 1988

[54] SCREWLESS TYPE ELECTRICAL TERMINAL BLOCK

[75] Inventors: Herbert C. Naylor, West Dundee; Deanna L. Gross, Bartlett, both of Ill.; Gregory J. Smith, North Attleboro, Mass.

[73] Assignee: Reed Devices, Inc., Carol Stream, Ill.

[21] Appl. No.: 85,280

[22] Filed: Aug. 12, 1987

Related U.S. Application Data

[63] Continuation of Ser. No. 765,368, Aug. 13, 1985, abandoned.

[51] Int. Cl.[4] ..... H01R 4/24

[52] U.S. Cl. ..... 439/441

[58] Field of Search ..... 439/725, 726, 727, 728, 439/729, 347, 436–441, 789, 806, 78

[56] References Cited

U.S. PATENT DOCUMENTS

| | | | |
|---|---|---|---|
| 2,477,955 | 5/1946 | Boynton | 339/200 P |
| 2,556,491 | 6/1951 | De Lorenzo | 339/274 |
| 3,022,481 | 2/1962 | Stepoway | 339/274 |
| 3,106,602 | 10/1963 | Hartz | 339/198 J |
| 3,474,389 | 10/1969 | Nagano | 339/274 |
| 3,526,870 | 9/1970 | Mayala | 439/397 |
| 3,753,193 | 8/1973 | Teagno et al. | 339/256 R |

FOREIGN PATENT DOCUMENTS

| | | | |
|---|---|---|---|
| 1166117 | 11/1958 | France | 339/17 LC |

*Primary Examiner*—Joseph H. McGlynn
*Attorney, Agent, or Firm*—Weingarten, Schurgin, Gagnebin & Hayes

[57] ABSTRACT

A cam-operated screwless electrical terminal block is provided having a generally box-shaped housing with an open top and an aperture in its front side and containing a generally C-shaped electrical terminal having vertically disposed opposing gripping elements the ends of which are adjacent the front aperture of the housing. The top opening carries a cam-lever pivotally mounted such that when the lever arm of the cam-lever is raised the electrical terminal ends are separated, and when the lever arm of the cam-lever is depressed the upper gripping element of the electrical terminal is depressed toward the lower gripping element so that a wire inserted in the front aperture of the housing between the ends of the gripping elements of the electrical terminal is securely held. The electrical terminal within the housing is adapted to make electrical contact with a circuit board and the terminal block is configured in such a way that a wide range of wire sizes may be conveniently and securely held. The cam-lever is provided with a flattened area on the portion of its face which contacts the upper gripping element of the electrical contact when the cam-lever arm is in the depressed position, and the housing and cam-lever arm possess respectively latching detents so that the cam-lever arm is securely maintained in its depressed position after an electrical connection has been made.

24 Claims, 3 Drawing Sheets

SCREWLESS TYPE ELECTRICAL TERMINAL BLOCK

This is a continuation of application Ser. No. 765,368, filed Aug. 13, 1985 and now abandoned.

FIELD OF THE INVENTION

This invention relates to electrical terminal blocks, and in particular, discloses a cam-operated screwless electrical terminal block.

BACKGROUND OF THE INVENTION

A wide variety of electrical terminal blocks are known. Most involve screw connectors in which a wire is wrapped around a screw and the screw is tightened to secure the connection. Others, those illustrated in U.S. Pat. Nos. 4,077,696 and 3,812,453 for example, have screws which activate a clamping piece which captures the wire and secures the electrical connection.

The screw-type terminal blocks are frequently rather bulky, resulting in a waste of printed circuit board space, and are labor intensive in that they require the wire to be wrapped around a screw which is then manually tightened by means of a screwdriver. They also suffer from the additional deficiency that they can be overtightened with the result that the wire is squeezed out from between the screw head and the opposing contact element. This is a particular problem with multistranded wire.

Various approaches to screwless terminals have suffered from the difficulties that the terminals could not be manufactured by high speed automated assembly methods, they were rather expensive, they could handle only a limited range of wire sizes, wire retention forces were frequently inadequate, they required one or more tools to insert or remove wires, and the designs produced long term fatigue stress in plastic or metal parts employed in such terminals.

In view of these problems it would be very desirable to have a simple inexpensive screwless connector having the ability to accommodate a wide range of wire diameters and also having strong wire retention forces to hold a connected wire securely.

SUMMARY OF THE INVENTION

The above-listed difficulties with existing connector designs are avoided, and the desired advantages in a screwless connector block are achieved in the present invention, which provides a screwless-type electrical terminal block having a housing the top of which has an opening adapted to receive and hold a cam-lever, and the front of which possesses a second opening for the insertion of a wire to be held. The housing contains an electrical terminal with at least two vertically disposed and opposing gripping elements, the upper gripping element being movable toward the lower gripping element in response to an applied downward force, at least one of the gripping elements being electrically conducting and adapted for connection to an electrical circuit. A cam-lever is mounted in the top opening of the housing in such a manner that the face of the cam contacts the electrical terminal upper gripping element and when the lever arm attached to the cam is lowered, the face of the cam depresses the upper gripping element, moving it toward the lower gripping element of the terminal and causing the gripping elements to clamp onto a wire inserted between them, making an electrical connection.

The cam-operated electrical terminal block of this invention offers a number of substantial advantages relative to the terminal blocks previously employed, among them being the following:

It is low cost and easy to assemble by hand or by automated equipment, it is compact to conserve printed circuit board space, it is labor saving in use since no screwdrivers or other tools are required to operate it, it is readily usable both in the field and in the factory, it is capable of accommodating a wide range of wire sizes and types, it exhibits good wire retention forces for both small and large diameter wires, it employs a compensating clamping mechanism which applies an adequate clamping force regardless of the diameter of the wire being connected, the clamping force is applied gradually and smoothly by operation of a cam with the result that the wire being clamped suffers minimal damage in the clamping process, the cam locks in a closed position automatically so that it is difficult to release the connected wire inadvertently during handling or use, and by virtue of the configuration employed the parts of the terminal block are designed to accommodate the residual stresses while the clamping mechanism is in use.

DESCRIPTION OF THE DRAWING

These and other features of the present invention are more fully set forth below in the solely exemplary detailed description and the accompanying drawing of which.

DETAILED DESCRIPTION OF THE INVENTION

Figure 1:
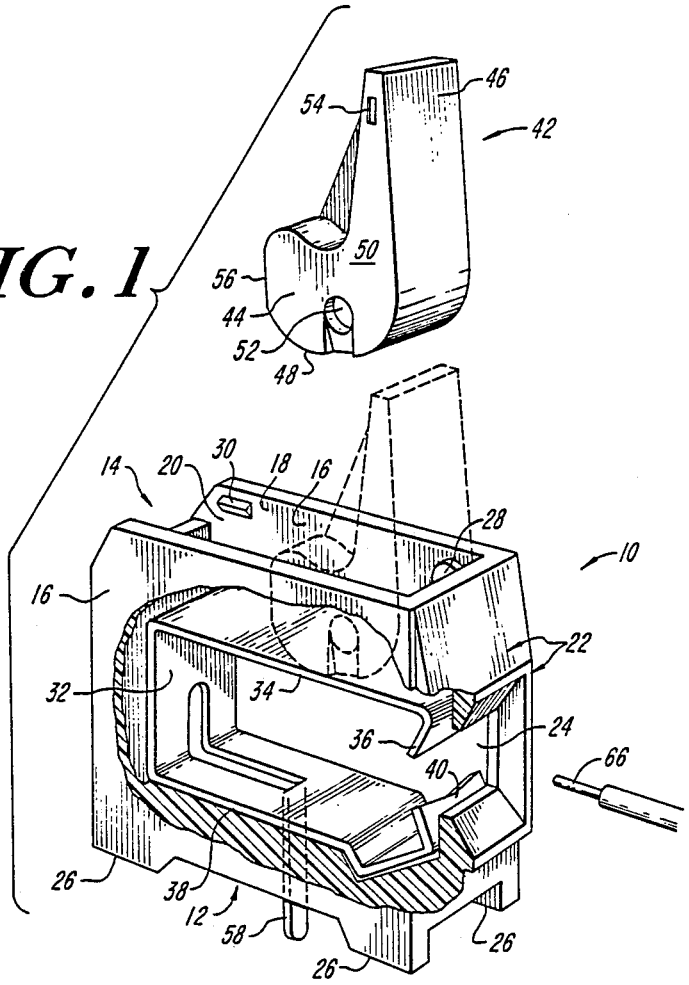
FIG. 1 is a perspective view of the terminal block of the invention, shown partially cut away and partially exploded to reveal internal details.

Referring now to the drawing, FIG. 1 shows the screwless-type electrical terminal block of the invention having a housing 10 which has a base 12, a rear 14, opposing sides 16 with inner surfaces 18, an open top 20 which constitutes a first opening in the housing, and a front 22 which possesses a second opening 24 in the housing. Base 12 is provided with standoffs 26. Each of the housing sides 16 possesses on its inner surface 18 a cylindrical boss 28 located on the upper portion of inner surface 18 and toward the front 22 of the housing. Bosses 28 are located opposite one another and serve as pivots for the cam-lever 42 to be described in more detail below. Each of the opposing housing sides 16 also possesses on its inner surface 18 a first latching detent 30 located on the upper portion of inner surface 18 toward the rear 14 of the housing.

Within housing 10 is located an electrical terminal 32 made of electrically conductive metal. Terminal 32 is adapted for connection to an electrical circuit, as will be described more completely below, and is generally C-shaped. Terminal 32 possesses a top portion 34 having a top end 36, and a bottom portion 38 having a bottom end 40. Top terminal end 36 and bottom terminal end 40 generally oppose each other and face toward front opening 24 of housing 10. The terminal top portion 34 and bottom portion 38 are located one above the other respectively and constitute upper and lower gripping elements. The lower gripping element, terminal bottom portion 38, is supported by base 12 of housing 10, and the upper gripping element, terminal top portion 34, is movable toward lower gripping element 38 in response to an applied downward force.

A cam-lever 42 is located in the top opening 20 of housing 10. Cam-lever 42 has a body portion 44, an integral lever arm 46, a cam face 48, and opposing sides 50. Each of the cam-lever sides 50 possesses a cavity 52 located in cam-lever body portion 44, and the respective cavities 52 are located opposite each other on the respective sides 50 of cam-lever 42. The cavities 52 mate with the cylindrical bosses 28 on the inner surfaces 18 of sides 16 of housing 10, bosses 28 serving as pivots upon which cam-lever 42 is mounted. Each of the cam-lever sides 50 also possesses a second latching detent 54 near the end of lever arm 46, so located as to mate with the corresponding latching detents 30 on inner surfaces 18 of sides 16 of housing 10. Cam face 48 contacts the upper portion 34 of electrical terminal 32, so that depressing cam-lever arm 46 causes cam face 48 to depress electrical terminal upper portion 34, moving it toward electrical terminal bottom portion 38. A wire 66 inserted between opposing electrical terminal ends 36 and 40 is thus securely held therein so long as cam-lever arm 46 remains depressed.

Cam face 48 possesses a flattened portion 56, which is in contact with electrical terminal upper portion 34 when cam-lever arm 46 is depressed. The combination of the interaction of flattened cam face 56 with electrical terminal top portion 34 on the one hand, and the interaction of cam-lever arm detents 54 with housing side latching detents 30 on the other hand cooperate to assure that when cam-lever 42 is rotated so that cam-lever arm 46 is depressed, cam-lever arm 46 is locked into this position until it is deliberately raised, thereby minimizing the risk of accidental release of a connected wire.

Electrical terminal 32 is adapted for connection to an electrical circuit by means of an electrically conductive pin 58 which extends through the base 12 of housing 10 to plug into an appropriate corresponding socket on a circuit board. Pin 58 may be formed from electrical terminal 32 as illustrated in FIG. 1, or may be attached to terminal 32 in any of the ways known to the art. Pin 58 may be attached to either the top portion 34 or the bottom portion 38 of electrical terminal 32, but in practice it will be most convenient to attach it to electrical terminal bottom portion 38, as shown in the figures.

Figure 2:
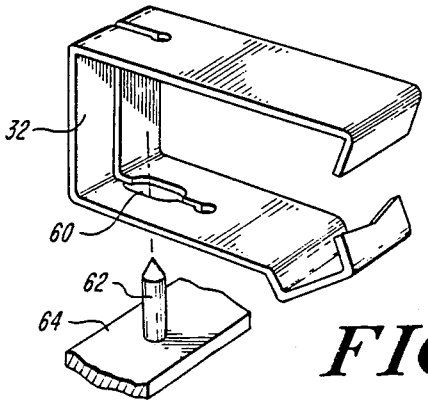
FIG. 2 shows an alternative embodiment of the electrical terminal employed within the terminal block.

An alternative means for connecting electrical terminal 32 to a circuit board is illustrated in FIG. 2, which shows an electrical terminal 32 having a slot 60 so configured as to accept an electrically conducting pin 62 which is attached to a header 64 on a circuit board.

Figure 3:
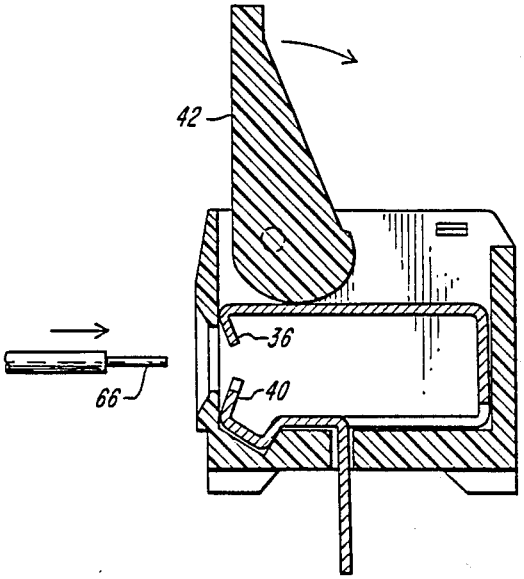
FIG. 3 is a cut-away side view of the electrical terminal block of the invention, in the open position.
Figure 4:
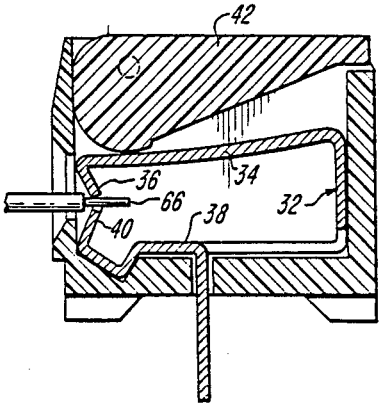
FIG. 4 is a cut-away side view of the terminal block of the invention in the closed position.

FIG. 3 shows a cut-away view of the terminal block of the invention with cam-lever 42 raised so that opposing electrical terminal ends 36 and 40 are open to permit the insertion of a wire 66. FIG. 4 shows a cut-away view of the terminal block of the invention with cam-lever 42 depressed and, in turn, depressing electrical terminal upper portion 34 and top end portion 36 down toward end 40 of terminal bottom portion 38. Wire 66, inserted between ends 36 and 40 of electrical terminal 32, is shown grasped and held between opposing ends 36 and 40.

Figure 5:
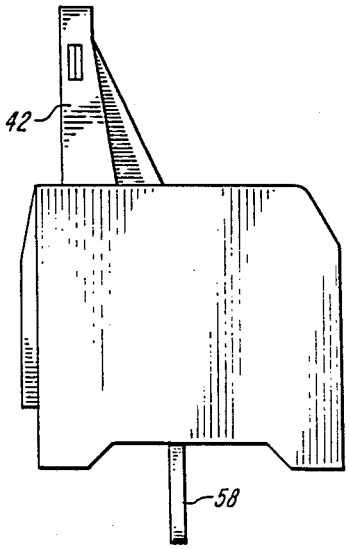
FIGS. 5 and 5A are side views of the terminal block of the invention illustrating alternative contact pin configurations.
Figure 7:
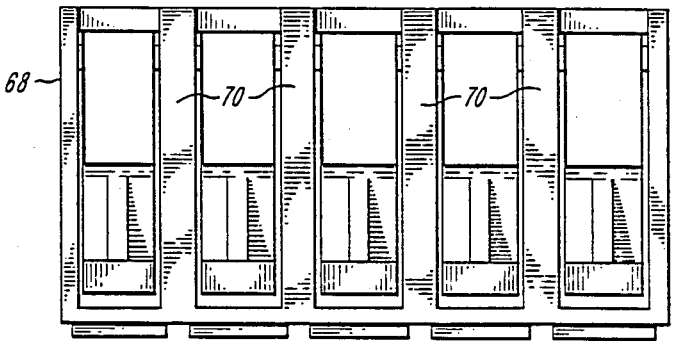
FIG. 7 is a top view of the terminal assembly of FIG. 6.
Figure 6:
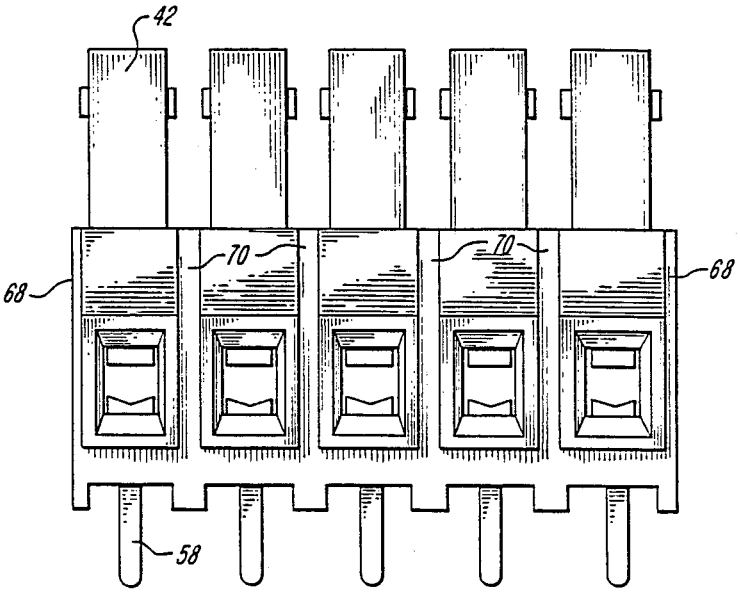
FIG. 6 is a front view of a multiple terminal assembly, shown in the open position.

FIG. 5 shows the side view of the terminal block of the invention with cam-lever 42 in the raised position and with contact pin 58 projecting approximately from the middle of the base of the terminal block as shown in FIG. 1. FIG. 6 shows a front view of a multiple terminal assembly corresponding to several of the terminal blocks shown in FIG. 5 and FIG. 1, all in a unitary housing. FIG. 6 also illustrates that it is contemplated that the terminal block of the invention will be manufactured in connected multiple units, the end sides 68 being half the thickness of the intervening sides 70 so that a number of such multiple units can be employed end to end, and the spacings between individual connectors will remain the same. FIG. 7 shows a top view of the bank of connectors shown in FIG. 6 and again illustrates that the end sides 68 of multiple terminal assembly units are half the thickness of the intervening sides 70 so that such units may be stacked end to end.

Figure 5A:
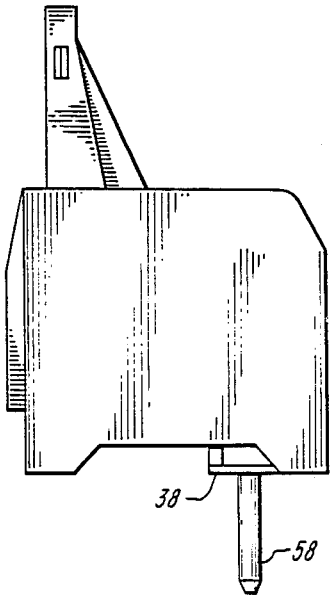

FIG. 5A shows a side view of a terminal block of the invention having a sturdy electrical connecting pin 58 attached toward the rear of electrical terminal bottom portion 38, in this case pin 58 is not formed from electrical terminal 32, but is attached to it as a separate conductive piece.

Although the invention has been exemplified in terms of a particular embodiment, it is not to be limited except by the scope of the appended claims.

What is claimed is:

1. A screwless-type terminal block, comprising:

a housing having a base, a passage through the base, an open top constituting a first opening, and a front possessing a second opening, said housing being adapted to receive and hold a cam-lever in said first opening;

an integral and generally C-shaped electrical terminal within said housing, said terminal including top and bottom portions which constitute respectively first and second gripping elements, said first gripping element being moveable toward said second gripping element in response to an applied force, said first gripping element having a first gripping end, said second gripping element having a second gripping end, said first and second gripping ends being generally opposed and projecting toward one another and formed to clamp a wire therebetween when said first gripping element is moved toward said second gripping element, said second gripping element being electrically conducting and having means for connection to a circuit board, said connection means being disposed to cooperate with the passage through the base of said housing to establish electrical connection between said second gripping element and the circuit board; and a cam-lever having a cam face, said cam-lever being mounted in said first opening such that said cam face contacts the electrical terminal first gripping element, and being operative to move said first gripping element toward said second gripping element, causing said gripping elements to clamp the wire inserted therebetween, to make an electrical connection.

2. The terminal block of claim 1 wherein said connection means is a conductive pin integral with said second gripping element.

3. The terminal block of claim 1 wherein said connection means is an expandable slot, and said passage through the base of said housing is adjacent to said expandable slot, permitting an electrically conducting pin connected to an external header to be inserted into said housing and into clamping contact with said second gripping element.

4. The terminal block of claim 1 wherein said housing possesses a rear as well as two opposing sides having inner surface, each of the opposing sides of said housing possessing on its inner surface a cylindrical boss located on the upper portion thereof toward the front of said housing and opposite the boss on the opposing housing side, each of the opposing sides of said housing also possessing on its inner surface a latching detent located on the upper portion thereof toward the rear of said housing.

5. The terminal block of claim 4 wherein said second gripping element is supported by the base of said housing.

6. The terminal block of claim 4 wherein said cam-lever possesses a body portion, an integral lever arm, and two opposing sides, each of said cam-lever sides possessing a cavity located in said body portion of said cam lever, each of said cavities being located opposite the cavity on the opposing cam-lever side, said cavities permitting mating of said cam-lever with the respective bosses on the two opposing sides of said housing, each of said cam-lever sides also possessing a detent near the end of said lever arm and so located as to mate with the respective latching detents on the two opposing sides of said housing.

7. The terminal block of claim 6 wherein said cam face possesses a flattened spot on the portion of said cam face which is in contact with the first gripping element when said lever arm is in the down position, to discourage accidental lifting of said lever arm.

8. A screwless-type electrical terminal block comprising:

a housing having a base, a passage through the base, a rear, two opposing sides with inner surfaces, an open top constituting a first opening, and a front possessing a second opening, each of the opposing sides of said housing possessing on its inner surface a cylindrical boss located on the upper portion thereof toward the front of said housing and opposite the boss on the opposing housing side, each of the opposing sides of said housing also possessing on its inner surface a latching detent located on the upper portion thereof toward the rear of said housing;

an integral electrical terminal within said housing, said terminal being made of electrically conductive metal, said terminal being generally C-shaped and possessing top and bottom portions, said top and bottom portions constituting respectively upper and lower gripping elements, said lower gripping element being supported by said housing base and having means for connection to a circuit board, said connection means being disposed to cooperate with the passage through the base of said housing, to establish electrical connection between said second gripping element and the circuit board, said upper gripping element being moveable toward said lower gripping element in response to an applied force;

said upper gripping element having an upper gripping end, said lower gripping element having a lower gripping end, said upper and lower gripping ends being generally opposed and projecting toward one another and formed to clamp a wire therebetween when said upper gripping element is moved toward said lower gripping element; and a cam-lever having a body portion, an integral lever arm, a cam face, and two opposing sides, each of said cam-lever sides possessing a cavity located in said body portion of said cam-lever, each of said cavities being located opposite the cavity on the opposing cam-lever side, said cavities permitting mating of said cam-lever with the respective bosses on the opposing sides of said housing, each of said cam-lever sides also possessing a detent near the end of said lever arm and so located as to mate with the respective latching detents on the housing sides, said cam face contacting said electrical terminal upper gripping element and depressing said upper gripping element toward said lower gripping element when said lever arm is depressed and locked into said detents, causing said gripping elements to clamp the wire inserted therebetween, making an electrical connection.

9. The terminal block of claim 8 wherein said connection means is a conductive pin integral with said lower gripping element.

10. The terminal block of claim 8 wherein said connection means is an expandable slot, and said passage through the base of said housing is adjacent to said expandable slot, permitting an electrically conducting pin connected to an external header to be inserted into said housing and into clamping contact with said lower gripping element.

11. A screwless-type electrical terminal block, comprising:

a housing of electrically insulative material and having a base adapted for mounting on a circuit board, the base having a passage therethrough to permit electrical connection with the circuit board, and the housing further having an interior cavity communicating with an open top and a front opening;

an integral and generally C-shaped electrical terminal supported in the cavity of the housing and having upper and lower gripping elements in normally spaced apart position confronting the front opening, said upper gripping element having a first gripping end, said lower gripping element having a second gripping end, said first and second gripping ends being generally opposed and projecting toward one another and formed to clamp a wire therebetween, said lower gripping element having means for connection to a circuit board, said connection means being disposed to cooperate with the passage through said housing base;

manually operable cam means including a cam-lever and cam body having a camming surface;

means for supporting the cam means on the housing for rotation of the cam body in the cavity of the housing in engagement with the upper gripping element, by rotation of the cam-lever disposed in the open top of the housing;

the cam means being operative with the cam-lever in a raised position to permit the gripping elements to remain apart for insertion of the wire therebetween via the front opening of the housing, and being operative with the cam-lever in a lowered position to cause the gripping elements to close to clamp the wire therebetween.

12. The terminal block of claim 11 wherein said connection means is a conductive pin integral with said lower gripping element.

13. The terminal block of claim 11 wherein said connection means is an expandable slot, and said passage through the base of said housing is adjacent to said expandable slot, permitting an electrically conducting pin connected to an external header to be inserted into said housing and into clamping contact with said lower gripping element.

14. A screwless-type electrical terminal block for connecting a wire to a circuit board, comprising:

a housing of electrically insulative material including:

a base having a connecting passage to the circuit board;

a top having a top opening; and a front having a front opening to receive the wire;

an integral, generally C-shaped terminal disposed within said housing including:

an upper gripping element;

a lower gripping element supported on said base;

a first end extending from said upper gripping element proximal said front of said housing and projecting generally toward said lower gripping element;

a second end extending from said lower gripping element proximal said front of said housing and projecting generally toward said upper gripping element and generally opposing said first end; and means for connection to the circuit board, disposed on the lower gripping element cooperate with said connecting passage in said base; and a cam means for moving said upper gripping element toward said lower gripping element to grip the wire inserted through said front opening between said first end and said second end, said cam means being rotatably mounted in said top opening and including:

a cam lever; and a cam surface engageable with said upper gripping element upon rotation of said cam means to move said upper gripping element toward said lower gripping element.

15. The terminal block of claim 14 wherein said means for connection to the circuit board comprises a conductive pin integrally formed on said lower gripping element and projecting through said connecting passage in said base to contact the circuit board.

16. The terminal block of claim 14 wherein said first end projecting from said upper gripping element is angled inwardly and away from said front opening; and said second end projecting from said lower gripping element is angled inwardly and away from said front opening.

17. The terminal block of claim 14 wherein said base includes standoffs for supporting said housing on the circuit board.

18. The terminal block of claim 14 wherein said cam means includes latching means to retain said cam means in engagement with said upper gripping element when said upper gripping element is moved toward said lower gripping element;

whereby the wire inserted in said front opening is gripped and retained between said first end and said second end.

19. The terminal block of claim 18 wherein said latching means includes a latching detent; and said housing includes a cooperative detent projecting inwardly into said top opening for engaging said latching detent;

whereby said latching detent is held by said cooperative detent when said cam means is rotated to cause said upper gripping element to move toward said lower gripping element.

20. The terminal block of claim 14 wherein said means for connection to the circuit board comprises a slot formed in said lower gripping element, to receive a conductive pin projecting from the circuit board and extending through said connecting passage in said base.

21. The terminal block of claim 20 wherein said slot extends into said upper gripping element.

22. A screwless-type electrical terminal block for connecting a wire to a circuit board, comprising:

a housing of electrically insulative material including:

a base having a connecting passage to the circuit board;

a top having a top opening; and a front having a front opening to receive the wire;

an integral, generally C-shaped terminal disposed within said housing including:

an upper gripping element;

a lower gripping element supported on said base;

a first end extending from said upper gripping element proximal said front of said housing and projecting generally toward said lower gripping element;

a second end extending from said lower gripping element proximal said front of said housing and projecting generally toward said upper gripping element and generally opposing said first end; and means for connection to the circuit board comprising a tongue cut from said lower gripping element said tongue having a substantially rectangular shape and being bent to project from said lower gripping element through said connecting passage to contact the circuit board; and a cam means for moving said upper gripping element toward said lower gripping element to grip the wire inserted through said front opening between said first end and said second end, said cam means being rotatably mounted in said top opening and including:

a cam lever; and a cam surface engageable with said upper gripping element upon rotation of said cam means to move said upper gripping element toward said lower gripping element.

23. A screwless-type electrical terminal block for connecting a wire to a circuit board, comprising:

a housing of electrically insulative material including:

a base having a connecting passage to the circuit board;

a top having a top opening; and a front having a front opening to receive the wire;

an integral, generally C-shaped terminal disposed within said housing including:

an upper gripping element;

a lower gripping element supported on said base;

a first end extending from said upper gripping element proximal said front of said housing and projecting generally toward said lower gripping element;

a second end extending from said lower gripping element proximal said front of said housing and projecting generally toward said upper gripping element;

means integral with said lower gripping element cooperative via said connecting passage in said base for connection with connecting means of the circuit board; and a cam means for moving said upper gripping element toward said lower gripping element to grip the wire inserted through said front opening between said first end and said second end, said cam means being rotatably mounted in said top opening and including:

a cam lever; and a cam surface engageable with said upper gripping element to move said upper gripping element toward said lower gripping element upon rotation of said cam means.

24. The terminal block of claim 23 wherein said uppon gripping element first end projects generally toward said lower gripping element and said lower gripping element second end projects generally toward said upper gripping element first end.

* * * * *

UNITED STATES PATENT AND TRADEMARK OFFICE

CERTIFICATE OF CORRECTION

PATENT NO. : 4,759,726

DATED : July 26, 1988

INVENTOR(S) : Herbert C. Naylor; Deanna L. Gross; Gregory J. Smith

It is certified that error appears in the above-identified patent and that said Letters Patent is hereby corrected as shown below:

| | |
|---|---|
| Column 4, line 36, | "screwless-type terminal" should read --screwless-type electrical terminal-- |
| Column 5, line 13, | "surface," should read --surfaces,-- |
| Column 7, line 37, | "element cooperate" should read --element to cooperate-- |
| Column 10, line 10, | "uppon" should read --upper-- |

Signed and Sealed this

Fifteenth Day of August, 1989

*Attest:*

*Attesting Officer*

DONALD J. QUIGG

*Commissioner of Patents and Trademarks*